United States Patent [19]

Gilmore et al.

[11] Patent Number: 4,603,515

[45] Date of Patent: Aug. 5, 1986

[54] VACUUM BLAST ADAPTER FOR BOMBS

[75] Inventors: Robert L. Gilmore, Las Vegas, Nev.; George E. Lander, Bolling AFB, D.C.

[73] Assignee: The United States of America as represented by the Secretary of the Air Force, Washington, D.C.

[21] Appl. No.: 219,397

[22] Filed: Dec. 22, 1980

[51] Int. Cl.[4] ..... B24C 9/00

[52] U.S. Cl. ..... 51/424; 51/427

[58] Field of Search ..... 51/424, 427, 429, 426, 51/410, 411; 15/344, 405

[56] References Cited

U.S. PATENT DOCUMENTS

| | | | |
|---|---|---|---|
| 1,480,575 | 1/1924 | Snider . | |
| 1,977,386 | 10/1934 | Holes | 51/8 |
| 3,075,318 | 1/1963 | Dilliard et al. | 51/427 X |
| 3,396,423 | 8/1968 | Hope | 51/410 X |
| 3,594,375 | 8/1971 | Nunemaker | 51/426 |
| 3,624,967 | 12/1971 | Kamper et al. | 51/427 X |
| 3,818,539 | 6/1974 | Fortune | 15/344 X |
| 4,045,915 | 9/1977 | Gilbert et al. | 51/427 |
| 4,132,039 | 1/1979 | Gilbert et al. | 51/424 |
| 4,212,138 | 7/1980 | Hutchison | 51/427 |
| 4,232,487 | 11/1980 | Brown | 51/427 X |

*Primary Examiner*—James G. Smith

*Attorney, Agent, or Firm*—Donald J. Singer; Jacob N. Erlich

[57] ABSTRACT

A vacuum blast adapter for removing corrosion from the booster wells of bombs and the like which includes a cylindrical body portion having a vacuum tight seal at its forward end for engaging the outer surface of the bomb. An air/abrasive carrying line is sealably inserted through the rearward end of the body portion to guide the abrasive into the bomb booster well. An observation window is provided at the top of the adapter and a funnel collector is positioned at the bottom to collect the used abrasive which is carried away by a vacuum line. An overhead spring suspension system facilitates the movement of the adapter to successive aligned bombs.

3 Claims, 5 Drawing Figures

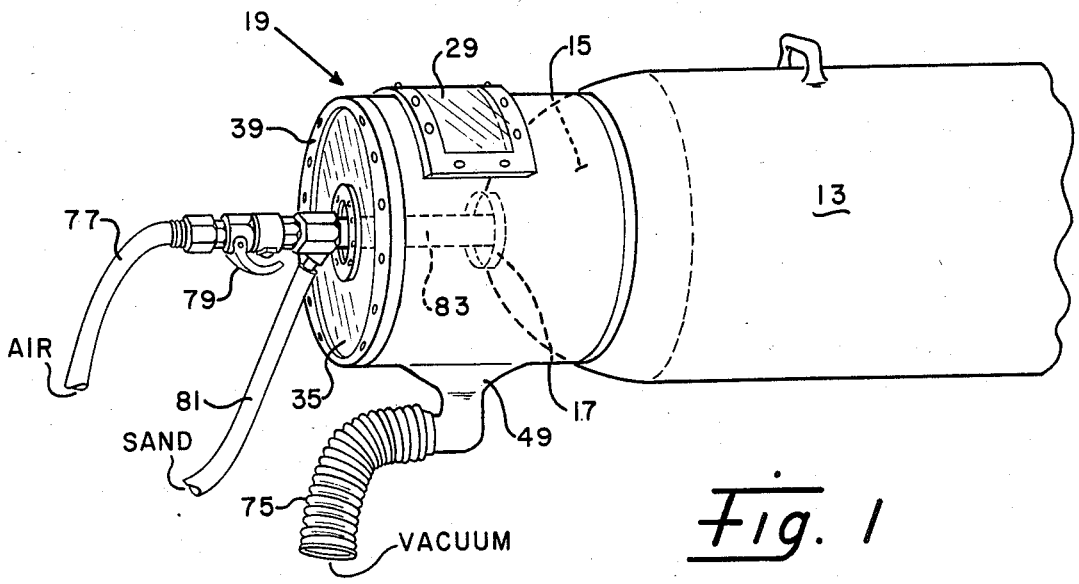
Fig. 1
Fig. 2
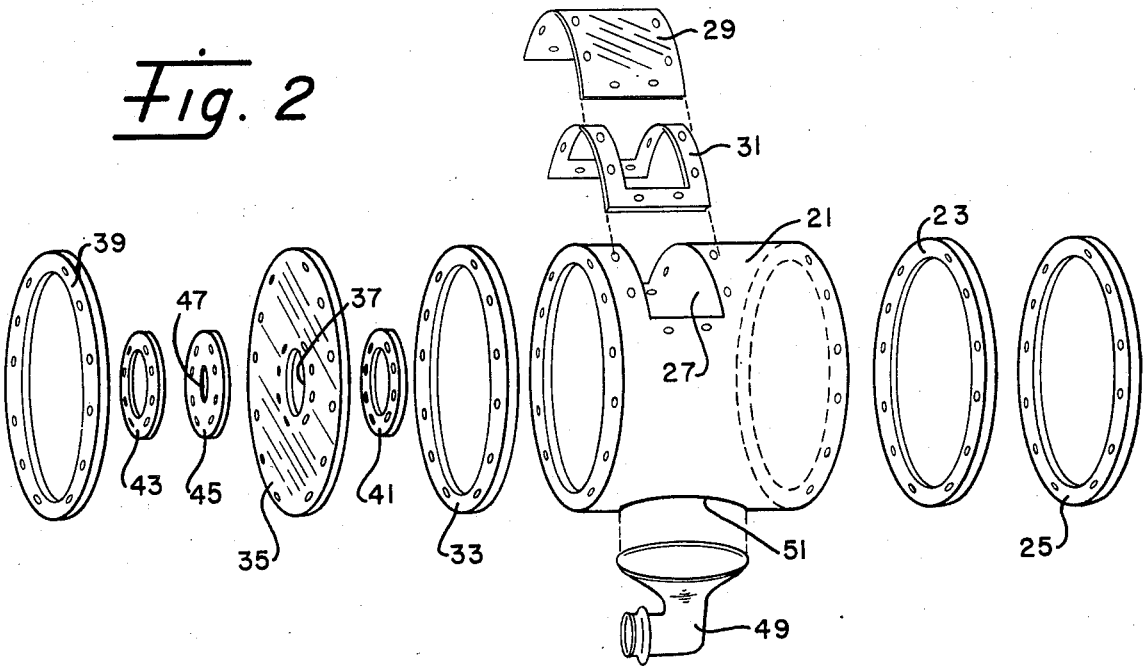

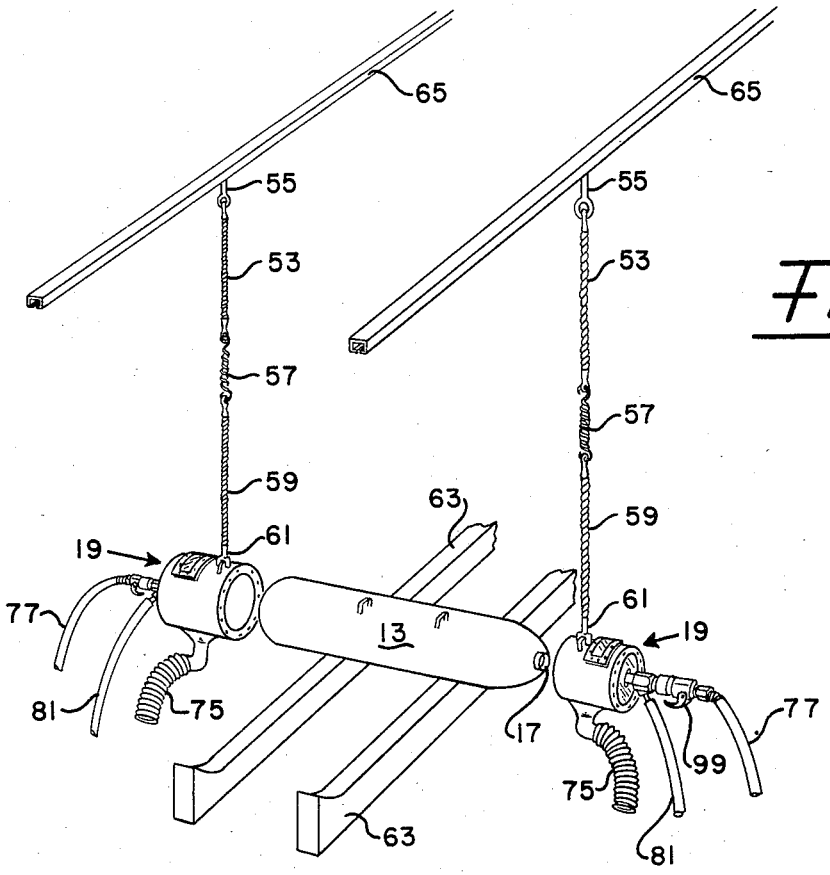
Fig. 3
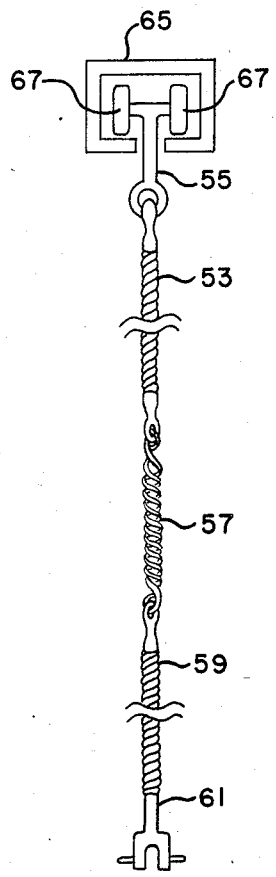
Fig. 4
Fig. 5
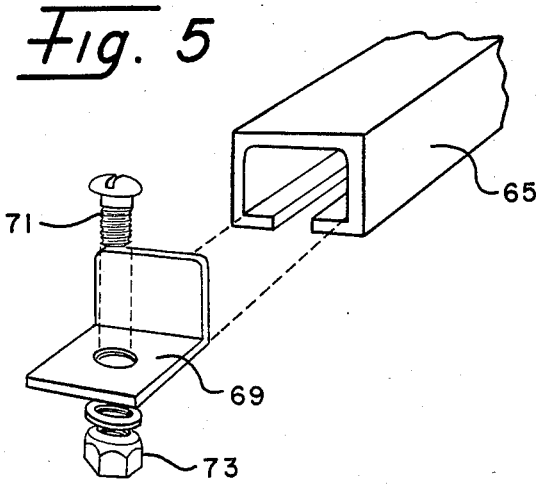

VACUUM BLAST ADAPTER FOR BOMBS

STATEMENT OF GOVERNMENT INTEREST

The invention described herein may be manufactured and used by or for the Government for governmental purposes without the payment of any royalty thereon.

BACKGROUND OF THE INVENTION

This invention relates to a sand blast apparatus for removing corrosion from general purpose bomb booster wells and the like, and more particularly, the invention is concerned with providing an adapter for use with sand or glass beads to remove corrosion from the nose and tail booster wells in a manner that prevents the escape of the abrasive material into the working area.

Heretofore, it has been common practice to sand blast the nose and tail booster wells of bombs in order to clean out rust and foreign matter which may have collected in these cavities. Using conventional equipment, the sand and rust particles from the blasting operation would normally escape into the atmosphere and create a bioenvironmental problem for workers and others breathing the silica dust produced in the area. Even with modern safety apparatus, some of the dust which is necessarily expelled into the atmosphere would be a danger to the people in the area and cause problems to the equipment in the immediate vicinity. Thus, it would be most desirable to provide an arrangement whereby any dust resulting from the blasting operation would be contained so that none of the silica dust and debris from the blasting apparatus could escape into the atmosphere. Also, the blasting operation should be capable of being handled by relatively unskilled personnel as well as being economical so that a large number of bombs can be handled quickly in a production type manner.

SUMMARY OF THE INVENTION

The invention is concerned with providing a vacuum blast adapter for removing corrosion from the nose and tail wells of general purpose bombs and the like. The device includes a cylindrical member fabricated of metal with one open end having a rubber gasket seal for engaging the outer surface of bomb and one closed end of plexiglass with a small central opening to receive an air gun and abrasive supply line. The wall of the cylindrical member includes a viewing window in its top surface and a collection sump with a vacuum line attached thereto in its bottom surface. The cylindrical member with the various lines attached is supported by an overhead spring suspension system which moves along tracks to facilitate the movement of the apparatus to successive, aligned workpieces.

Accordingly, it is an object of the invention to provide a vacuum blasting adapter for removing corrosion from general purpose bomb booster wells wherein the adapter is sealed onto the bombs by the vacuum in the system.

Another object of the invention is to provide a vacuum blasting adapter for the removal of corrosion from the booster wells of general purpose bombs wherein there is no escape of silicon dust into the atmosphere and, consequently, no loss of abrasive material.

Still another object of the invention is to provide a vacuum blast adapter for vacu-blasting booster wells in all sizes and types of general purpose bombs wherein the adapter can be quickly and easily installed and/or removed in a matter of seconds from the workpiece.

A further object of the invention is to provide an apparatus suitable for removing the corrosion from the nose and tail booster wells of general purpose bombs wherein the operator of the apparatus has excellent visibility allowing close observation of the entire cleansing process.

A still further object of the invention is to provide a vacuum blasting adapter for removing corrosion from general purpose bomb booster wells wherein the need for elaborate respirators is eliminated because no silica dust is allowed to escape into the atmosphere.

Still another object of the invention is to provide a vacuum blasting apparatus which is substantially mobile and can be used in any location where there is available air pressure.

These and other objects, features and advantages will become more apparent after considering the following detailed description taken in conjunction with the annexed drawings and appended claims.

BRIEF DESCRIPTION OF THE DRAWINGS

FIG. 1 is a view in perspective of a vacuum blast adapter according to the invention attached to a general purpose bomb;

FIG. 2 is an exploded view of the vacuum blast adapter of FIG. 1 showing the various seals, washers and flanges:

FIG. 3 is a general view of two vacuum blast adapters ready for use showing overhead suspension rails and the rail system for feeding the bombs;

FIG. 4 is a detail view of the overhead rail system from which the vacuum adapter is suspended during operation; and FIG. 5 is a view in perspective of the stop assembly which is installed at each end of the overhead suspension rails.

DESCRIPTION OF A PREFERRED EMBODIMENT

Referring now to the drawings wherein like reference numerals refer to like elements in the several views. FIG. 1 shows a bomb 13 having a booster well 15 at each end thereof. Each booster well 15 is provided with an opening 17 through which the arming devices and materials can be installed therein. These booster wells 15 are subject to the corrosive effects of the weather especially when the bomb 13 is stored over an extended period of time and this corrosion can have a detrimental effect as the bomb 13 after it has been armed. The present invention provides a safe and economical way of removing the corrosion from the bomb booster wells 13 prior to arming.

An adapter 19 shown more clearly in FIG. 2 includes a body portion 21 of substantially cylindrical configuration open at both ends. The front end of the body portion 21 which contacts the bomb 13 is provided with an annular rubber seal 23 held in place by the metal flange 25. The rubber seal 23 presses against the outer surface of the bomb 13 when the adapter 19 is in operating position. An opening 27 is made in the upper surface of the adapter 19 near the back end and a clear plastic window 29 is located over the opening 27. A rubber gasket 31 is positioned between the window 29 and the surface of the adapter 19 near the edges of the opening 27 in order to provide an airtight seal therebetween.

The open rearward end of the adapter 21 is provided with an annular rubber seal 33 for producing an air tight connection between a larger plastic disc 35 with a cut out portion 37 and the rear surface of the body portion 21. A metal flange 39 holds the disc 35 against the rubber seal 33 and the body portion 21. A pair of smaller plastic discs 41 and 43 are attached, one on each side of the large plastic disc 35, and a rubber seal 45 with a small opening 47 is positioned between the seal 43 and the disc 35. Thus, when assembled, the only opening in the rearward end of the adapter 19 is the small opening 47 in the rubber seal 45 through which an air/abrasive line can be inserted. A bead recovery funnel 49 is welded to the bottom of the body portion 21 which is provided with an opening 51 to allow the abrasive sand and/or glass beads to fall into the funnel 49.

In FIG. 3, there is shown an adapter suspension system for removing corrosion from a number of bombs 13. The adapter 19 is suspended from an upper cable 53, the upper end of which is attached to an eye hook 55. A coil suspension spring 57 is attached between the lower end of the upper cable 53 and the upper end of a lower cable 59. The lower end of the lower cable 59 is attached to the adapter 19 by means of a yoke 61 which engages a complementary eye on the adapter body 21 so that the adaptor 19 is held suspended. The bomb 13 is mounted to roll along the rails 63 in order to allow easy loading and unloading of the bombs 13. The adapters 19 are suspended on the rails 65 shown in cross-section in FIG. 4 and include the rollers 67 which are adapted to roll along the rails 65 to facilitate the movement of the adapter 19 to successive workpieces. In FIG. 5 there is shown a stop 69 which is fastened at each end of each rail 65 by means of the bolt 71 and the nut 73. This arrangement prevents the rollers 67 from disengaging from the rails 65 during the aligning procedure.

In operation, the adapter 19 is pressed against the bomb 13 as shown in FIG. 1 and the vacuum line 75 is activated causing the adapter 19 to be sealed onto the bomb 13. Compressed air is allowed to pass through the air line 77 when the valve 79 is pressed causing sand to be drawn through the sand line 81 and mixed with the compressed air. The mixture of air and sand passes through the air/abrasive line 83 into the bomb booster well opening 17 cleaning the well of corrosion. The blasted sand and dust is drawn into the funnel 49 by the vacuum through the vacuum line 75 back into the sump (not shown) to be reused in the vacu-blast system.

The rails shown in FIG. 3 can be mounted in a forty foot trailer so that the system is entirely mobile and the bombs can be cleaned at any convenient location where compressed air is available. The abrasive material used may consist of sand or glass beads and since the vacuum line causes all of the material to be recovered, none is lost in the process of corrosion removal. Also, since none of the dust escapes during the vacu-blasting operation, the need for elaborate respirators is eliminated and the system is suitable for use where bioenvironmental conditions are critical.

Although the invention has been illustrated in the accompanying drawings and described in the foregoing specification in terms of a preferred embodiment thereof, the invention is not limited to this embodiment. It will be apparent to those skilled in the art that the hereinbefore described vacuum blast adapter can be used in other operations where it is necessary and/or desirable to remove the accumulated corrosion from enclosed areas of a workpiece. Also, it should be noted that certain changes, modifications and substitutions can be made in the construction details of the invention without departing from the true spirit and scope of the appended claims.

Having thus set forth the nature of our invention, what we claim and desire to secure by Letters Patent of the United States is:

1. A vacuum blast adapter for use with an air/abrasive carrying line for removing corrosion from the interior of a bomb booster well, the interior of the bomb booster well being exposed to surrounding ambient air by a booster well opening, said vacuum blast adapter comprising:

a body portion of substantially cylindrical configuration;

an annular rubber seal on the forward end of said body portion for contacting the outer surface of said bomb booster well adjacent said bomb booster well opening and providing a vacuum type seal between said bomb booster well and said body portion of said adapter;

means on the rearward end of said body portion for permitting the sealable insertion of said air/abrasive carrying line therethrough in order for said air/abrasive carrying line to protrude through said body portion and into said interior of said bomb booster well in order to guide abrasive into the interior of said bomb booster well, said sealable insertion permitting means including an annular rubber seal positioned against the rearward end of said body portion, a large plastic disc with a central cut out therein positioned against said annular seal, a pair of smaller plastic discs having central cut outs therein positioned one on each side of said large plastic discs, a rubber disc having a small opening therein positioned between one of said small plastic discs and said large plastic disc, and a metal flange pressed tightly against said large plastic disc with said rubber seal providing a vacuum tight seal therebetween, said air/abrasive carrying line being positioned through the small opening in said rubber disc;

a transparent window disposed in the upper surface of said body portion, said window being vacuum-tightly sealed to prevent the entrance of said ambient air into the interior of said body portion, thereby allowing the close observation of said insertion of said air/abrasive carrying line into said bomb booster well opening and the observation of the entire vacuum blasting operation; and means for recovering all of the used abrasive from said body portion for reuse, said abrasive recovering means including a cut out portion in the lower surface of said body portion of said adapter, an abrasive recovery funnel with the larger end thereof fixedly attached adjacent said cut out portion, and a vacuum line attached to the smaller end of said funnel for drawing the used abrasive out of said body portion of said adapter thereby preventing any of the abrasive from escaping into said ambient air surrounding said body portion of said adapter.

2. The vacuum blast adapter for removing corrosion from bomb booster wells defined in claim 1 wherein said adapter is supported by an overhead spring suspension system comprising an elongated rail, a pair of rollers in engagement with said rail for rolling movement therealong, an eye hook extending downward from said rollers, a first cable having its upper end attached to said eye hook, a coil spring having its upper end attached to the lower end of said first cable, a second cable having its upper end attached to the lower end of said coil spring, the lower end of said second cable being attached to the upper surface of the adapter, thereby allowing the adapter to be easily adjusted for movement along a row of bombs being vacuum blasted.

3. A system for removing corrosion from the interior of a bomb booster well, the interior of the bomb booster well being exposed to the surrounding ambient air by a booster well opening, said system comprising:

a pair of spaced apart parallel rails for guiding a plurality of bombs therealong, each of said bombs having a bomb booster well;

at least one vacuum blast adapter for use with an air/abrasive carrying line for removing the corrosion from the interior of said bomb booster well, the interior of said booster well being exposed to surrounding ambient air by the booster well opening, said vacuum blast adapter including a body portion of substantially cylindrical configuration, an annular rubber seal on forward end of said body portion for contacting the outer surface of said bomb booster well adjacent said bomb booster well opening and providing a vacuum type seal between said bomb booster well and said body portion of said adapter, means on the rearward end of said body portion for permitting the sealable insertion of said air/abrasive carrying line therethrough in order for said air/abrasive carrying line to protrude through said body portion and into said interior of said bomb booster well in order to guide abrasive into the interior of said bomb booster well, a transparent window disposed in the upper surface of said body portion, said window being vaccum-tightly sealed to prevent the entrance of said ambient air into the interior of said body portion, thereby allowing the close observation of said insertion of said air/abrasive carrying line into said bomb booster well opening and the observation of the entire vacuum blasting operation, and means for recovering all of the used abrasive from said body portion for reuse, said abrasive recovering means including a cut out portion in the lower surface of said body portion of said adapter, an abrasive recovery funnel with the larger end thereof fixedly attached adjacent said cut out portion, and a vacuum line attached to the smaller end of said funnel for drawing the used abrasive out of said body portion of said adapter thereby preventing any of the abrasive from escaping into said ambient air surrounding said body portion of said adapter; and means for supporting said vacuum blast adapter adjacent said plurality of bombs, said supporting means including an overhead spring suspension system having an elongated rail, a pair of rollers in engagement with said rail for rolling movement therealong, an eye hook extending downward from said rollers, a first cable having its upper end attached to said eye hook, a coil spring having its upper end attached to the lower end of said first cable, a second cable having its upper end attached to the lower end of said coil spring, the lower end of said second cable being attached to the upper surface of said adapter, thereby allowing said adapter to be easily adjusted for movement along a row of said bombs being vacuum blasted.

* * * * *